US005710707A

United States Patent [19]

Heiden

[11] Patent Number: 5,710,707

[45] Date of Patent: Jan. 20, 1998

[54] POSTAGE METERING SYSTEM INCLUDING PRIMARY ACCOUNTING MEANS AND MEANS FOR ACCESSING SECONDARY ACCOUNTING MEANS

[75] Inventor: Gary M. Heiden, Shelton, Conn.

[73] Assignee: Pitney Bowes Inc., Stamford, Conn.

[21] Appl. No.: 560,223

[22] Filed: Nov. 21, 1995

[51] Int. Cl.[6] ..... G07B 17/04

[52] U.S. Cl. ..... 364/464.2

[58] Field of Search ..... 364/464.02, 464.03, 364/464.11, 464.2; 395/200.14, 650

[56] References Cited

U.S. PATENT DOCUMENTS

| | | | |
|---|---|---|---|
| 4,251,874 | 2/1981 | Check, Jr. | 364/464.2 |
| 4,253,158 | 2/1981 | McFiggans | 364/464.02 |
| 4,471,441 | 9/1984 | Check, Jr. | 364/464.2 |
| 4,760,532 | 7/1988 | Sansone et al. | 364/464.03 |
| 4,812,992 | 3/1989 | Storace et al. | 364/464.02 |
| 4,813,912 | 3/1989 | Chickneas et al. | 364/464.02 |
| 4,831,554 | 5/1989 | Storace et al. | 364/464.02 X |
| 4,831,555 | 5/1989 | Sansone et al. | 364/464.02 X |
| 4,837,701 | 6/1989 | Sansone et al. | 364/464.03 |
| 4,853,864 | 8/1989 | Hart et al. | 364/464.02 |
| 4,858,138 | 8/1989 | Talmadge | 364/464.02 |
| 4,907,161 | 3/1990 | Sansone et al. | 364/464.02 |
| 5,140,675 | 8/1992 | Okada | 395/114 |
| 5,200,903 | 4/1993 | Gilham | 364/464.02 |
| 5,535,279 | 7/1996 | Seestrom | 380/55 |

*Primary Examiner*—Edward R. Cosimano
*Attorney, Agent, or Firm*—Charles R. Malandra, Jr.; David E. Pitchenick; Melvin J. Scolnick

[57] ABSTRACT

A postage metering system includes primary accounting structure and non-secure printing structure. The primary accounting structure includes a primary computer which includes structure for sequentially metering respective postage values for printing on respective sheets, structure for detecting a plurality of fault conditions, and structure for disabling the metering structure when the detecting structure detects a selected fault condition. The non-secure printing structure includes a printing module and a printing computer. The printing module includes printing apparatus and structure for sequentially feeding thereto each sheet of a batch thereof having a predetermined plurality of sheets. The printing computer includes structure for transmitting a first request for connection of the printing structure in communication with the primary accounting structure for receiving therefrom respective postage values for printing on respective sheets. The primary computer also includes structure responsive to the first connection request for causing connection of the accounting structure in communication with the printing structure if the metering structure is not disabled. The primary computer further includes structure for causing disconnection of the accounting structure from communication with the printing structure if connected in communication therewith when the metering structure is disabled. The printing computer includes structure for transmitting a second request for connection of the printing structure in communication with secondary accounting structure for receiving therefrom respective postage values for printing on respective sheets if the metering structure is disabled.

11 Claims, 7 Drawing Sheets

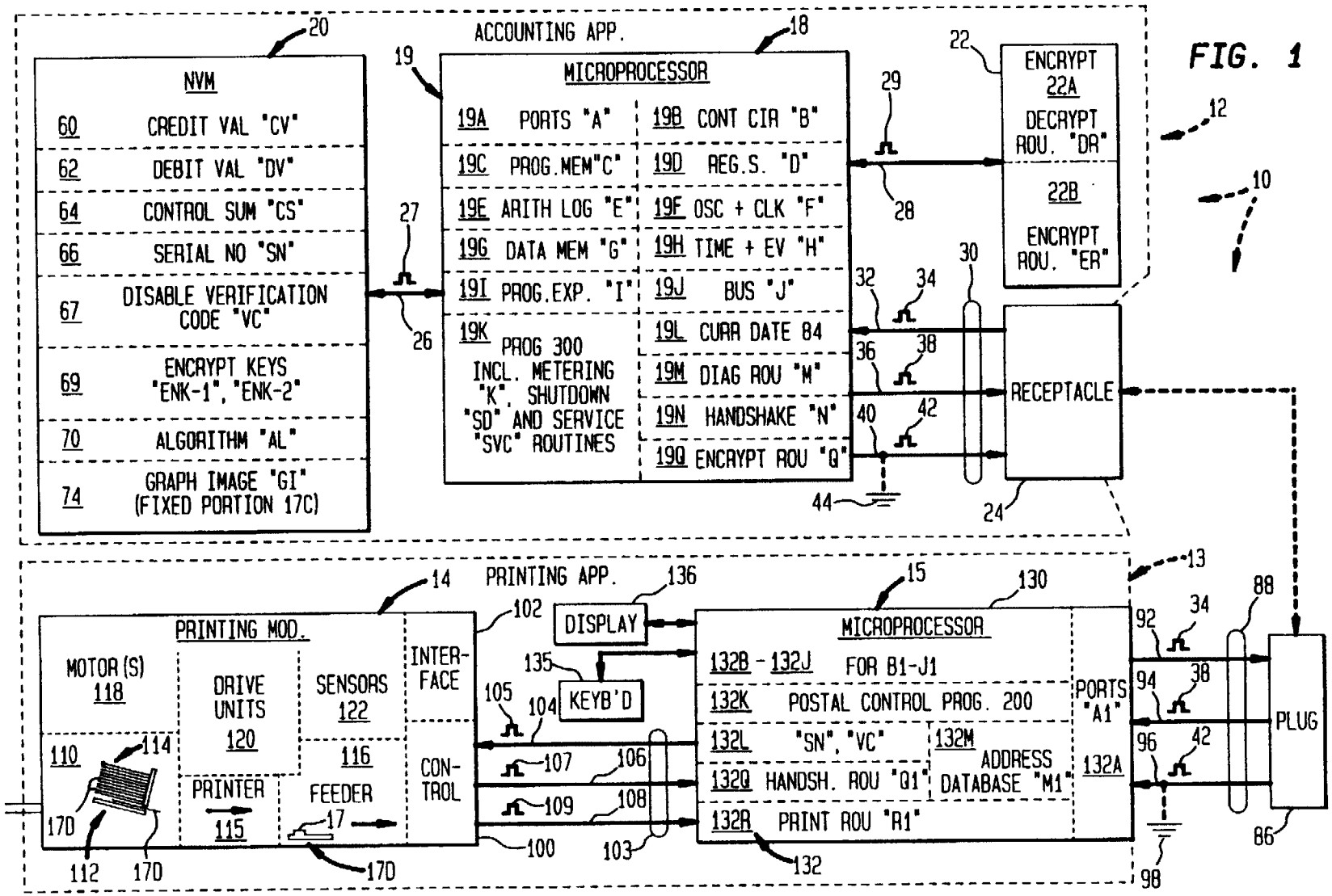
FIG. 1
10
12
13
14
15
18
19
20
22
24
26
27
28
29
30
32
34
36
38
40
42
44
86
88
92
94
96
98
100
102
103
104
105
106
107
108
109
110
112
114
115
116
117
118
120
122
130
132
132A
132B - 132J
FOR B1-J1
132K
POSTAL CONTROL PROG. 200
132L
"SN", "VC"
132M
ADDRESS DATABASE "M1"
132Q
HANDSH. ROU "G1"
132R
PRINT ROU "R1"
PORTS "A1"
MICROPROCESSOR
PRINTING APP.
DISPLAY
KEYB'D
INTER-FACE
CON-TROL
SENSORS
FEEDER
PRINTING MOD.
DRIVE UNITS
PRINTER
MOTOR(S)
170
PLUG
RECEPTACLE
ENCRYPT 22A
DECRYPT ROU. "DR"
22B
ENCRYPT ROU. "ER"
ACCOUNTING APP.
MICROPROCESSOR
19A PORTS "A"
19B CONT CTR "B"
19C PROG.MEM "C"
19D REG.S. "D"
19E ARITH LOG "E"
19F OSC + CLK "F"
19G DATA MEM "G"
19H TIME + EV "H"
19I PROG.EXP. "I"
19J BUS "J"
19K PROG 300 INCL. METERING "K", SHUTDOWN "SD" AND SERVICE "SVC" ROUTINES
19L CURR DATE 84
19M DIAG ROU "M"
19N HANDSHAKE "N"
19Q ENCRYPT ROU "Q"
NVM
60 CREDIT VAL "CV"
62 DEBIT VAL "DV"
64 CONTROL SUM "CS"
66 SERIAL NO "SN"
67 DISABLE VERIFICATION CODE "VC"
69 ENCRYPT KEYS "ENK-1", "ENK-2"
70 ALGORITHM "AL"
74 GRAPH IMAGE "GI" (FIXED PORTION 17C)

POSTAGE METERING SYSTEM INCLUDING PRIMARY ACCOUNTING MEANS AND MEANS FOR ACCESSING SECONDARY ACCOUNTING MEANS

BACKGROUND OF THE INVENTION

This invention is generally concerned with a postage metering system, and more particularly with a postage metering system having separate printing and primary accounting and means for accessing secondary accounting means when the primary accounting apparatus is shut down.

In the course of conducting a search concerning the subject matter of the present invention, the following references were found: U.S. Pat. No. 4,253,158 for a System For Securing Postage Printing Transactions, issued Feb. 24, 1981 to McFiggins; U.S. Pat. No. 4,812,992 for a Postage Meter Communication System, issued Mar. 14, 1989 to Storace et al.; U.S. Pat. No. 4,831,554 for a Postage Meter Message Printing System, issued May 16 1989 to Storace et al.; U.S. Pat. No. 4,831,555 for an Unsecured Postage Applying System issued May 16, 1989; U.S patent application Ser. No. 356,747 for a Postage Accounting System Including Means For Separately Transmitting Fixed And Variable Information For Driving An External Printer, filed Dec. 15, 1994 by Seestrom, issued as U.S. Pat. No. 5,535,279, U.S. patent application Ser. No. 356,749 for a Postage Accounting System Including Means For Transmitting Encoded Variable Postage And Letter Addressing Information For Driving An External Printer, filed Dec. 15, 1994 by Ramadei, issued as U.S. Pat. No. 5,602,921 U.S. patent application Ser. No. 356,748 for a Postage Meter Including Means For Encrypting Plain Text Versions Of Mailing Addresses For Inclusion With Postage Indicia, filed Dec. 15, 1994 by Seestrom (Attorney Docket No. E-308); and, the references listed in each of the foregoing Patent Applications, including, but not limited to, U.S. Pat. No. 5,140,675 for a Printer Controller Apparatus Interfacing With External Data Sources, issued Aug. 18, 1992 to Okada.

Of the foregoing references, the '158 Patent to McFiggins is of interest in that it describes an early postage meter which includes separate printing and postage accounting stations interconnected through an insecure communications link. In addition, '555 Patent issued to Sansone et al, is of interest in that is describes the provision of a plurality of postage metering units which may be connected to a remotely located data center via a telephone link. Further, the Patent Applications are of interest due to their each describing a postage metering system, including separate printing and accounting apparatus, which may be modified to include the subject matter of the present invention. And, the '576 Patent issued to Okada is of interest in that it describes printing apparatus which is connectable to multiple signal sources. Moreover, the references of interest generally show that in a typical postage metering system may include separate printing and accounting apparatus connected in communication with one another for processing batches of mailpieces. Further, the references of interest generally show that the accounting apparatus includes a descending register having funds stored therein which correspond to a total value of postage available for printing, and that in the course of processing a batch of mailpieces the total postage value is sequentially decremented by respective increments to be printed on the respective mailpieces. Moreover, the references of interest generally show that if the total postage value is not enough for processing a batch of mailpieces, such processing must wait until the accounting apparatus is connected via a telephone link to a remotely located data center for crediting the descending register with sufficient funds to process the batch of mailpieces.

On the other hand the references are silent concerning the provision of an alternate source of postage values for processing batches of sheets, such as letters, when the primary accounting apparatus of a postage metering system experiences a critical-fault type of malfunction condition before or after commencement of processing the batch of sheets, with the result that the accounting apparatus is disabled from metering postage values and is thus not available for processing the batch. Although being an inconvenience to any User, a large number of Users of postage metering systems are involved with processing mass mailings of time sensitive batches of letters, including billings, and the disablement their accounting apparatus causes such Users to experience costly downtime of their batch mail processing activities. Thus, it is desirable that an alternate source of supply of postage be made available to at least some Users of postage metering systems when their accounting apparatus is disabled. Accordingly:

an object of the invention is to provide a postage metering system, including printing means removably connectable to primary postage value accounting means, and including secondary postage value accounting means connectable to the printing means when the primary accounting means is or becomes disabled from metering postage values.

SUMMARY OF THE INVENTION

A postage metering system comprising: primary accounting means including primary computer means, the primary computer means including means for sequentially metering respective postage values for printing on respective sheets, the primary computer means including means for detecting a plurality of fault conditions, the primary computer means including means for disabling the metering means when the detecting means detects a selected fault condition; printing means including a printing module and printing computer means, the printing module including printing apparatus and means for sequentially feeding thereto each sheet of a batch thereof having a predetermined plurality of sheets, the printing computer means including means for transmitting a first request for connection of the printing means in communication with the primary accounting means for receiving therefrom respective postage values for printing on respective sheets; the primary computer means including means responsive to the first connection request for causing connection of the accounting means in communication with the printing means if the metering means is not disabled, the primary computer means including means for causing disconnection of the accounting means from communication with the printing means if connected in communication therewith when the metering means is disabled; and the printing computer means including means for transmitting a second request for connection of the printing means in communication with secondary accounting means for receiving therefrom respective postage values for printing on respective sheets if the metering means is disabled.

BRIEF DESCRIPTION OF THE INVENTION

As shown in the Drawings, wherein like reference numerals designate like or corresponding parts throughout the several views:

FIG. 1 is a schematic view of the postage metering system according to the invention, including separate printing and primary accounting apparatus;

FIGS. 2 an elevation of a sheet having a preferred embodiment of a postage indicia printed thereon in accordance with alphanumeric and graphic information received from either the primary or secondary accounting apparatus;

FIG. 2A is an elevation of the sheet of FIG. 2 having another embodiment of a postage indicia printed thereon in accordance with other alphanumeric and graphic information received from either the primary or secondary accounting apparatus; and FIG. 3 is schematic view a data processing center according to the invention, which includes secondary accounting means to which the printing apparatus of FIG. 1 may be connected if the primary accounting means is disabled from metering postage values;

DESCRIPTION OF THE PREFERRED EMBODIMENTS

As shown in FIG. 1, a postage metering system 10 according to the invention generally comprises secure, primary, postage value accounting apparatus 12 and printing apparatus 13, which are physically separated from each other.

Figure 2:
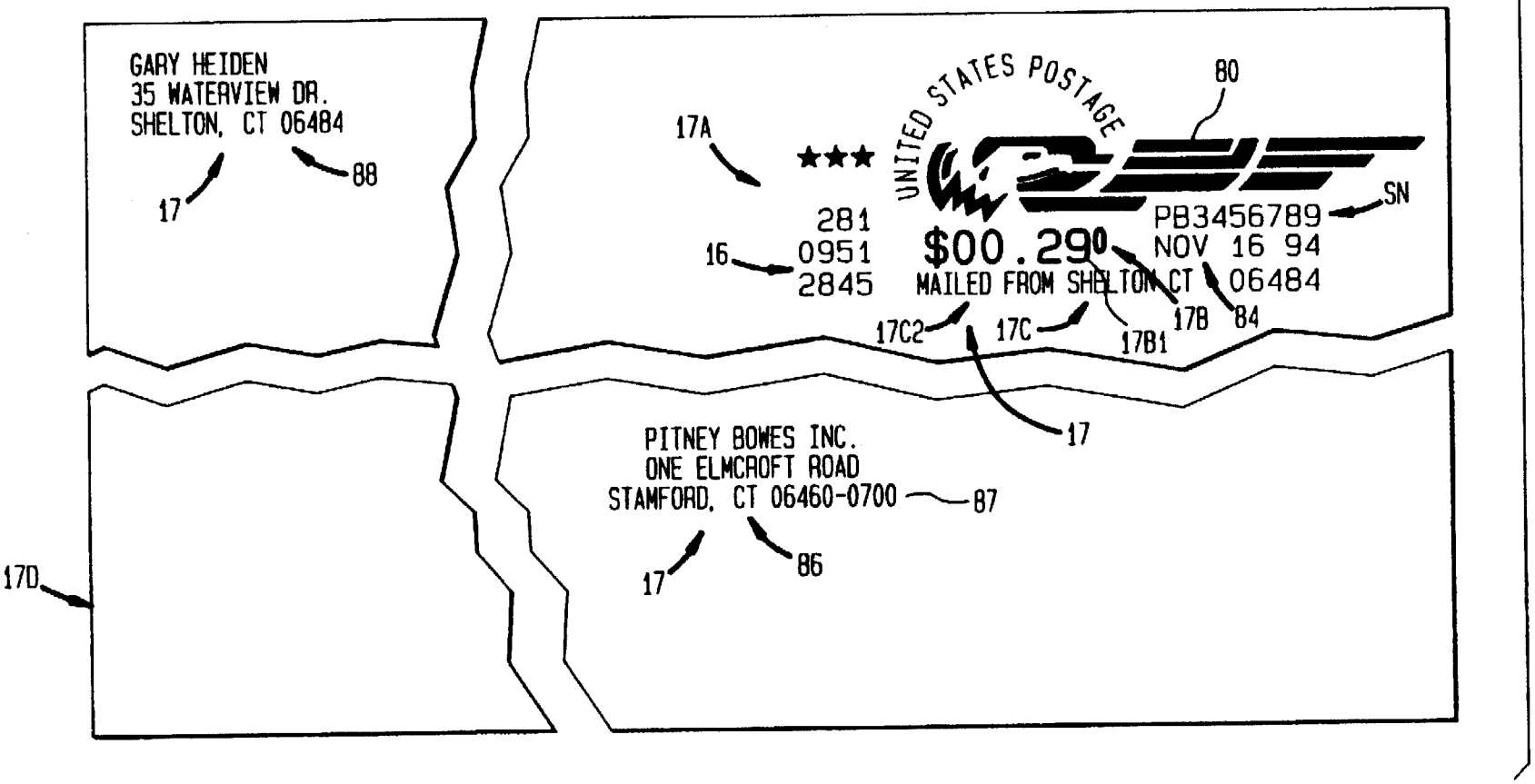

The printing apparatus 13 (FIG. 1), which may be either secure or non-secure, generally includes a printing module 14, and a printing, computer 15 therefor for controlling the printing of alphanumeric and graphic information 17 (FIGS. 2 and 2A), including the postage indicia 17A, and optionally including the addresses, 86 and 88 respectively, of the addressee and addressor and an encryption code 16, on a sheet 17D, such as a letter, card or envelope or the like, or such as a label or the like which is suitable for affixation to an article, to be mailed or shipped. The postage indicia 17A comprises a variable portion 17B, including a postage value 17B1. In addition, the postage indicia 17A comprises a fixed portion 17C, including information which identifies the geographic location 17C2 of the primary postage accounting apparatus 12 (FIG. 1), as exemplified by the location "SHELTON CT" (FIG. 2) or "CAMBRIDGE MD" (FIG. 2A) or a corresponding Postal Zip Code in lieu thereof or in combination therewith as illustrated by the Zip Code "06484" (FIG. 2). Moreover, the fixed portion 17C of the embodiment of the postage indicia 17A shown in FIG. 2A preferably includes a town circle 17C1 within which the geographic location 17C2, or corresponding Postal Zip code, is printed. The printing apparatus 13 (FIG. 1) is conventionally adapted to be connected in communication with the primary accounting apparatus 12 for sequentially obtaining therefrom respective postage indicia 17A (FIGS. 2 and 2A) for printing on respective sheets 17D of a predetermined plurality thereof known in the art as a "batch" of sheets 17D.

The primary postage value accounting apparatus 12 (FIG. 1) generally comprises conventional primary computer structure including a suitable microprocessor 18. The microprocessor 18 includes conventional structure 19, having a portion 19A thereof for providing a sufficient number of communications ports "A", including interrupts, which are either already available or are programmable for serial, parallel or asynchronous communications, as the case may be, to provide a separate communications link for each of the internal components of the accounting apparatus 12 and for connection thereof to each external device, such as the printing apparatus 13. Moreover, the microprocessor structure 19 includes a portion 19B thereof for providing a plurality of control circuits "B", a portion 19C thereof for providing program memory circuits "C", a portion 19D thereof for providing a plurality of working and spare register circuits "D", a portion 19E thereof for providing an arithmetic logic unit "E", a portion 19F thereof for providing circuits for one or more oscillators and clocks "F", a portion 19G thereof for providing data memory circuits "G", a portion 19H thereof for providing a plurality of timers and event counters "H", a portion 19I thereof for providing a program expansion control circuit "I", and a portion 19J thereof for providing an internal communications bus "J". Of course, the primary computer structure may comprise a plurality of microprocessors 18 for providing added capacities which may be called for in the course of implementation of the invention.

According to the invention, the microprocessor structure 19 (FIG. 1) also preferably includes a portion 19K thereof for storing a primary computer application program 300 for controlling the various operations of the primary computer structure and thus of the primary accounting apparatus 12. The program 300 is preferably constructed and arranged to include a conventional postage value metering routine "K" for metering postage values 17B1 to the printing apparatus 13 under the control of the program 300. The program 300 also preferably includes, a conventional shut down routine "SD" for disabling the postage accounting apparatus structure from metering postage values 17B1, and thus disabling the aforesaid routine "K". Moreover, in accordance with a preferred embodiment of the invention, the shut down routine "SD" may include suitable steps for causing the primary computer 15 to store a disablement verification code "VC" in the printing apparatus 13 when the postage value metering structure "K" of the primary accounting apparatus 12 is disabled. The structure 19 preferably includes a portion 19L for storing the current date 84. Moreover, the microprocessor structure 19 includes a portion 19M thereof for storing a conventional diagnostic routine "M", of the application program 300, for causing the microprocessor 18 to conventionally sense the physical status of the primary accounting apparatus 12, and the electrical status of various ports and ongoing processes of the microprocessor 18 and of the critical data stored in the NVM 20 hereinafter discussed, and to detect the occurrence a plurality of predetermined malfunction conditions thereof.

Figure 5:
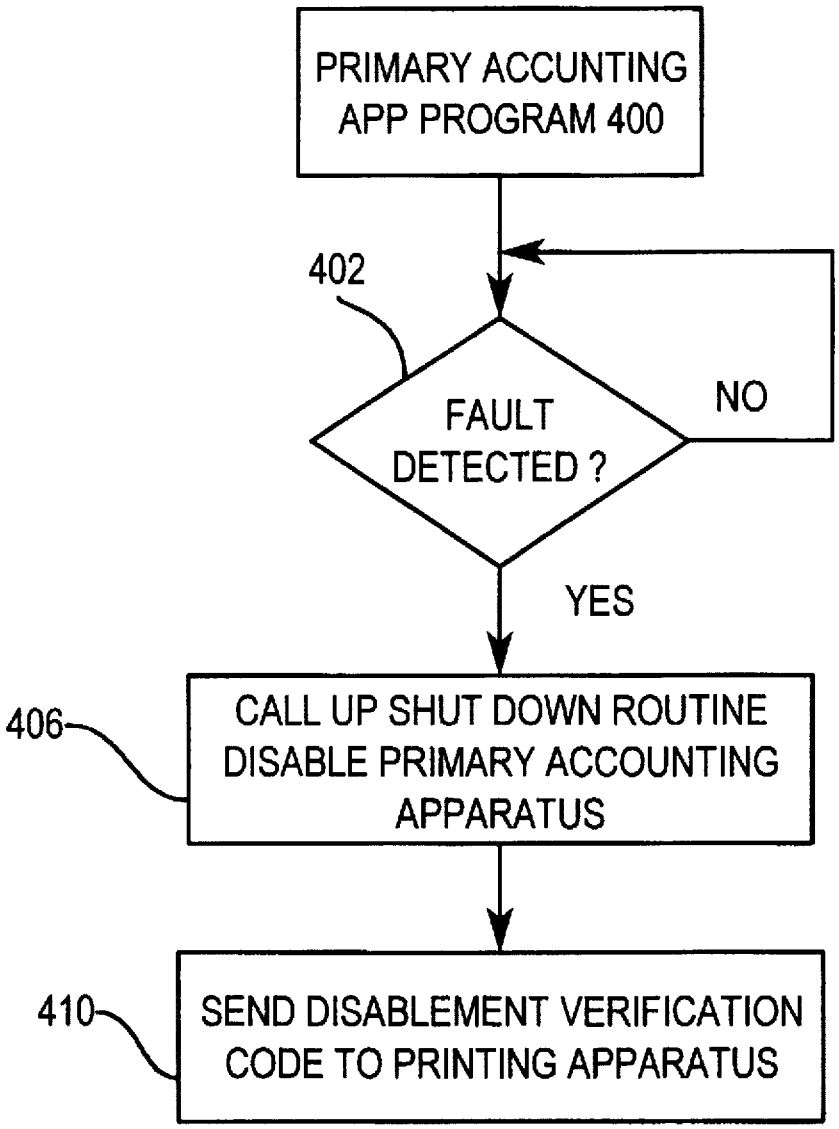
FIG. 5 is a flow chart of the generation of the disablement verification code when a fault is detected in the primary computer application program.

As is well known in the art, one or more of such malfunction conditions may be of the type known in the art as "critical fault" conditions. Such critical fault conditions are generally those which have been identified as physical or electrical events which may be indicative of the occurrence of a breach in the security of the primary accounting apparatus 12 (FIG. 1) including in the NVM 20. Accordingly, the primary computer program 300 is preferably constructed and arranged such that when the diagnostic routine "M" detects a critical fault malfunction condition (FIG. 5, step 402) the program 300 causes the microprocessor 18 to call up and implement the shut down routine "SD" (FIG. 5, step 406). Whereupon, the primary accounting apparatus 12 is disabled from metering postage values 17B1, until an authorized representative of the Postal Service or manufacturer of the primary accounting apparatus 12, or other authorized service person, cures the detected malfunction condition and returns the accounting apparatus 12 to service, and, in a preferred embodiment, a disablement verification code "VC" is stored in the printing apparatus 13 under the control of the program 300 (FIG. 5, step 410), for use in requesting connection of the printing apparatus 13 in communication the secondary accounting apparatus 520 as hereinafter discussed.

Figure 3:
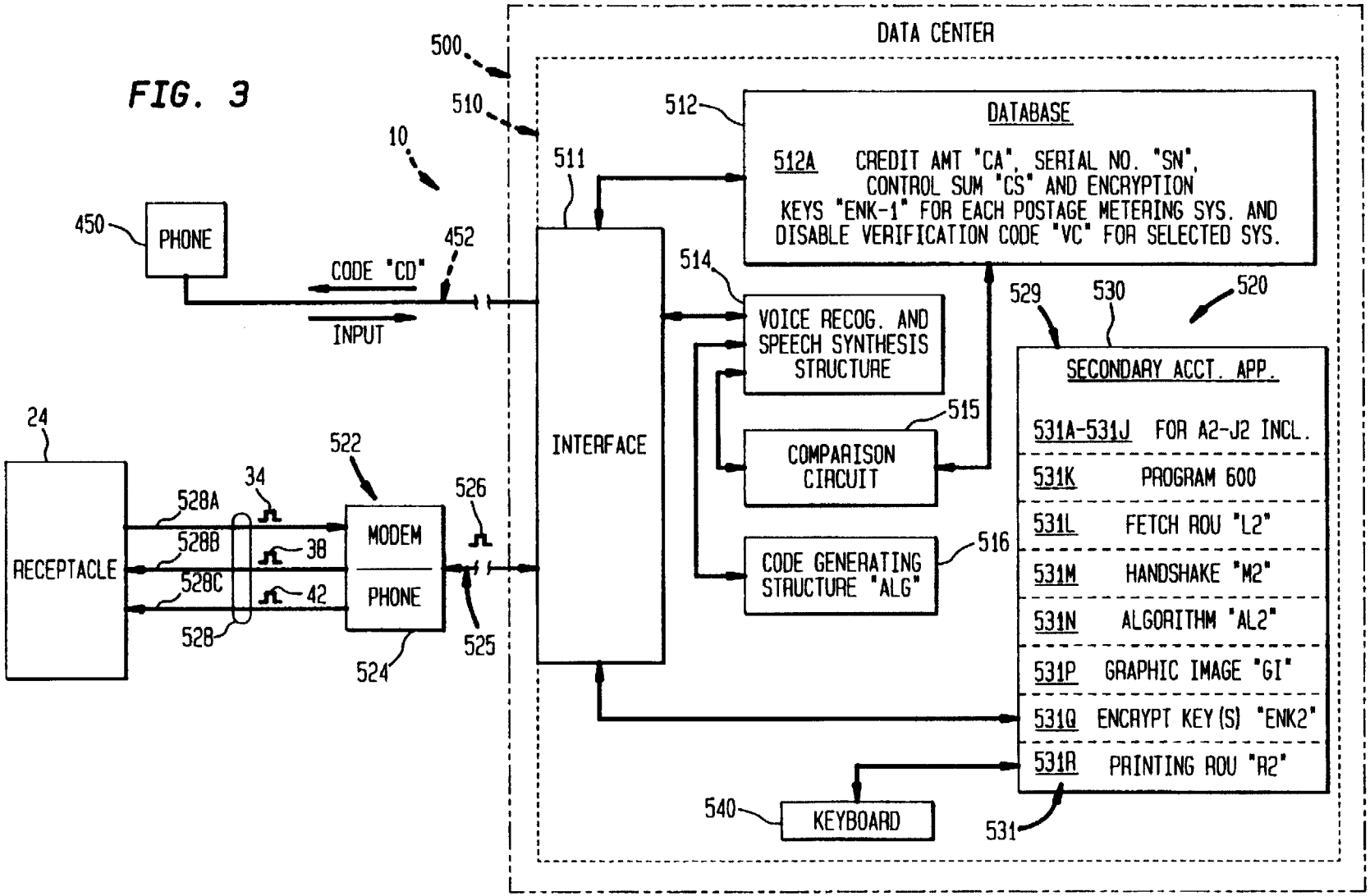

The primary computer program 300 (FIG. 1) also includes a suitable service routine "SVC", which is conventionally available for use by authorized service personnel for clearing the primary accounting apparatus 12, and thus the primary computer, of respective malfunction conditions and returning the apparatus 12 to service. Whereupon, in accordance with a preferred embodiment of the invention, the authorized service person is preferably obliged to call the data center 500 (FIG. 3), hereinafter discussed, and report the return to service of the primary postage accounting apparatus 12 (FIG. 1), to permit authorized personnel to timely discontinue permitting the User from receiving data corresponding to postage indicia 17A (FIG. 2), and thus respective postage values 17B1, from the secondary accounting apparatus 520 (FIG. 3). Further, the microprocessor structure 19 preferably includes a portion 19N thereof for storing a conventional handshake routine "N" of the application program 300, which preferably utilizes the-serial number "SN" of the postage accounting apparatus 12, for connection thereof in communication with authorized printing apparatus 13. And, as hereinafter discussed, the microprocessor structure 19 may include a portion 19Q thereof for storing an encryption routine "Q" of the application program 300.

The primary accounting apparatus 12 (FIG. 1), or primary computer structure, also generally includes suitable non-volatile memory (NVM), encryption and interface structures, respectively designated 20, 22 and 24, which are conventionally connected to the microprocessor 18 and operable under the control thereof, and, more particularly, under the control of the primary computer program 300. The non-volatile memory structure (NVM) 20 is suitably electrically connected to the microprocessor 18 by means of a conventional communications link 26, extending from the microprocessor bus "J", for transmitting and receiving data signals, such as the signal 27, and synchronizing communications between the microprocessor 18 and NVM 20. In addition, the encryption structure 22 is suitably electrically connected to the microprocessor 18 by means of a conventional communications link 28, extending from the microprocessor bus "J", for transmitting and receiving data signals, such as the signal 29, and synchronizing communications between the microprocessor 18 and encryption structure 22. And, the interface structure 24, which is preferably a suitable receptacle, is suitably electrically connected to the microprocessor 18 by means of a serial, parallel or asynchronous communications link, represented by the serial communications link 30. The link 30 includes a data input lead 32, for receiving data signals, such the signal 34, from the printing apparatus 13, a data output lead 36, for providing data signals, such as the signal 38, to the printing apparatus 13, and a clock lead 40, for providing clock signals, such as the signal 42, to the printing apparatus 13 for synchronizing communications therebetween. Of course, assuming the provision of an asynchronous communications link 30, the lead 40 would be connected to the sink 44 of the accounting module 12.

Figure 2A:
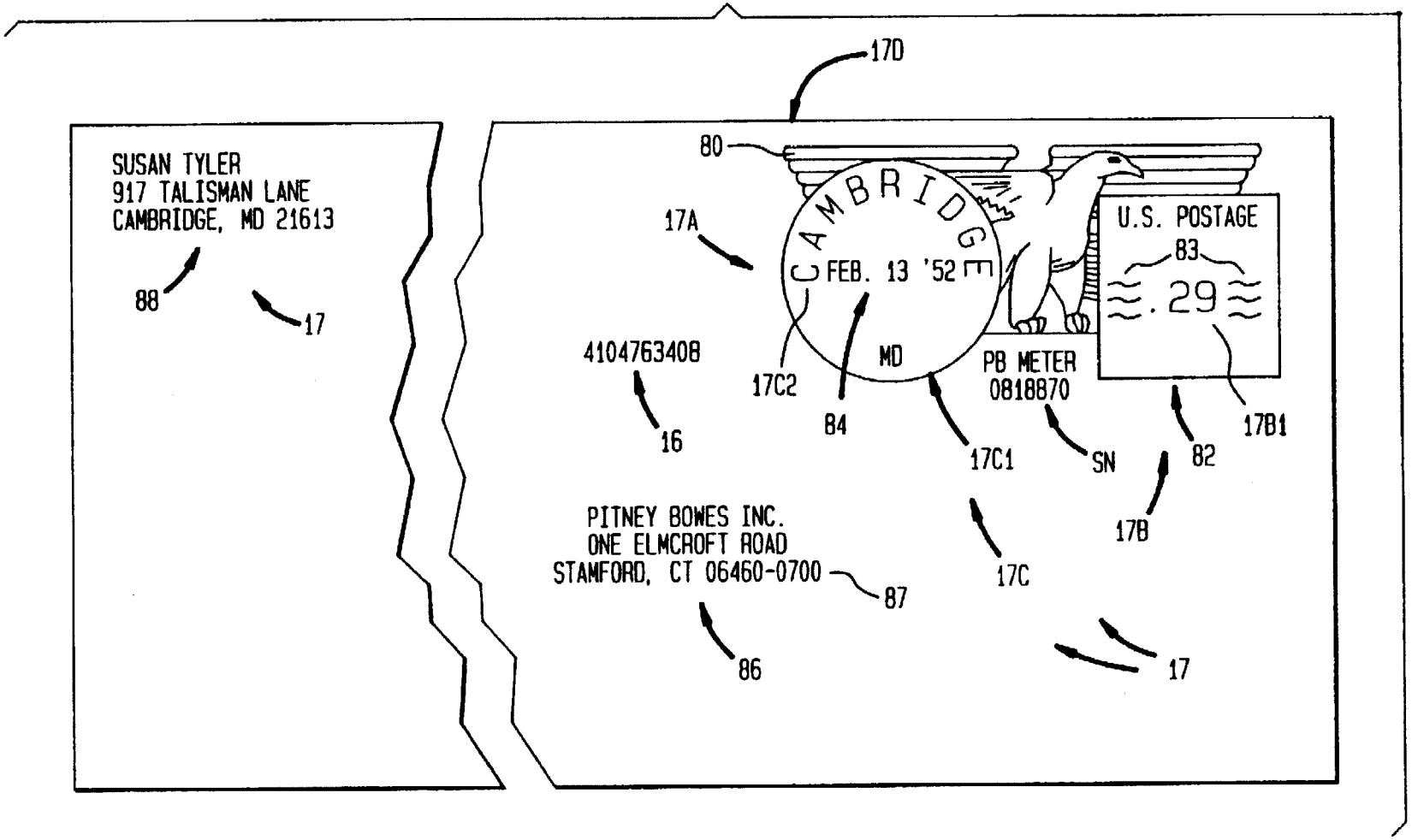

The NVM 20 (FIG. 1) may be any commercially available non-volatile memory of the type which is suitable for use for storing various values which are critical to the operation of the postage metering system 10. The NVM 20 includes conventional structure 60, known in the art as a descending register, for storing data corresponding to a current total postage credit value "CV", which is the total postage value currently available for printing. In addition, the NVM 20 includes structure 62, known in the art as an ascending register, for storing data corresponding to a current total debit value "DV", which is the total of all increments of the current total postage value which have at any time been decremented from any total credit value "CV". Further, the NVM 20 includes structure 64 for storing a control sum "CS", which is the sum of the aforesaid credit and debit values, "CV" and "DV". In addition, the NVM 20 includes structure 66 for storing a serial number "SN" of the accounting apparatus 13. Further, in a preferred embodiment, the NVM 20 includes structure 67 for storing a predetermined disablement verification code "VC", which is as unique to the postage accounting apparatus 12 as is the serial number "SN" thereof. Moreover, the NVM 20 preferably includes structure 69 for storing a plurality of sequentially available first encryption keys "ENK-1", and, as hereinafter discussed, for optionally storing one or more second encryption keys "ENK-2". And, the NVM 20 includes structure 70 for storing a conventional algorithm "AL" for causing the microprocessor 18 to sequentially decrement, or reduce, the credit value "CV" stored in the descending register 60 and sequentially increment, or increase, the debit value "DV" stored in the ascending register 62, respectively, by sequential amounts which are respectively equal to the current postage value 17B1 (FIG. 2) of the postage indicia 17A which is to be printed by the printing apparatus 13 (FIG. 1), in the course of the printing apparatus 13 sequentially processing sheets 17D. Further, the NVM 20 (FIG. 1) preferably includes structure 74 for storing data corresponding to the fixed, graphic image "GI", portion 17C (FIG. 2 or 2A) of a postage indicia 17A. As noted above, the fixed portion 17C (FIG. 2 or 2A) of the postage indicia 17A may comprise the town circle 17C1 (FIG. 2A including the identity of a geographic location 17C2 situated therewithin, or comprise the identity of the geographic location in plain text 17C2 (FIG. 2) together with the corresponding Postal Zip Code. According to the invention, the fixed, graphic image "GI", portion 17C, may also include one or more or all of the remainder of the fixed portion 17C of the postage indicia 17A, including the eagle 80, which may be a trademark of Pitney Bowes Inc. (FIG. 2A), or other notation identifying the manufacturer of the primary postage accounting apparatus, or, as shown in FIG. 2, the eagle 80 as required by a Postal Service. In addition, the fixed portion 17C may include notation such as the notation "PB METER" (FIG. 2A) or "PB" (FIG. 2) together with the serial number "SN" of the primary postage accounting apparatus such as the serial number "3456789" (FIG. 2) or "081887" (FIG. 2A). Moreover, the fixed portion 17C may comprise a postage value box portion 82 (FIG. 2A) which may or include therein the notation "U.S.POSTAGE", or may simply include the notation "UNITED STATES POSTAGE" (FIG. 2). Further, the fixed portion 17C may include the three "wavy" lines 83 (FIG. 2A), known in the art as wings, on opposite sides of the postage value "0.29". Moreover, without departing from the spirit and scope of the invention, the fixed, graphic image "GI", portion 17C may include a temporarily fixed portion of the postage indicia 17A such as the current date 84.

The encryption structure 22 (FIG. 1) is preferably conventionally operable under the control of the microprocessor 18, and thus under the control of the primary computer program 300. The encryption structure 22 includes a portion 22A thereof for storing a suitable decryption routine "DR", of the application program 300, for utilizing the next available encryption key "ENK-1" for decrypting respective codes, as hereinafter discussed, which are obtained by the User from the data center 500 and have embedded therein data corresponding to postage funds to be credited, or added, to the total credit value "CV". In addition, the encryption structure 22 includes a portion 22B thereof for storing therein a suitable encryption routine "ER" which utilizes the encryption key(s) "ENK-2" for encrypting data corresponding to any, some or all of the alphanumeric or graphic information, or both, which is to be printed in plain text on the sheet 17D, to provide verifiable encrypted information 16 (FIG. 2) for printing by the printing apparatus 14. Thus the encryption structure 22 (FIG. 1) is operable under the control of the microprocessor 18 for encrypting data corresponding to one or more of the numerical values stored in the NVM 20 or microprocessor 18, or both, including the current date 84 (FIG. 2 or 2A), current postage value 17B1 of the postage indicia 17A, a portion of the data corresponding to each mailing address 86, such as the zip code 87, and a part of the fixed, graphic image "GI", portion 17C. Without departing from the spirit and scope of the invention, the encryption structure 22 may be a suitable electrical circuit which is located externally of the microprocessor 18, or the encryption circuit routine "Q" of the application program 300 for controlling the microprocessor 18. As noted above, the encrypted information 16 printed on the envelope 17D is characterized as being "verifiable". In this connection it is noted that assuming the Postal Service has a computer having stored therein the encryption routine "Q" and the encryption keys "ENK-2", then, the plain text alphanumeric and graphic information on the face of the envelope 17D which was encrypted by the microprocessor 18 may be read from the envelope 17 and encrypted by the Postal Service computer to produce encrypted information which may then be compared to the encrypted information 16 printed on the envelope 17D, in order to verify that they are the same.

The printing apparatus 13 is conventionally removably connectable in communication with the primary accounting apparatus 12 by means of a suitable electrical plug 86 of a communications link 88 of the printing apparatus 13. The communications link 88 includes a data output lead 92, for providing data signals, such the signal 34, to the microprocessor 18, a data input lead 94, for receiving data signals, such as the signal 38, from the microprocessor 18 and a clock lead 96, for receiving clock signals, such as the signal 42, from the microprocessor 18 for synchronizing communications between the microprocessor 18 and printing system 13. Of course, assuming the provision of an asynchronous communications link 30 at the primary accounting apparatus 12, the lead 96 would be connected to the sink 98.

The printing module 14 (FIG. 1) is preferably a conventional, standalone, device, which includes suitable structure 100, such as a microprocessor, for controlling the various structures and functions of the module 14. The printing module 14 may include a conventional operator interface 102, such as a suitable keyboard, which is conventionally coupled to the control structure 100 for providing input signals thereto in response to actuation of the keyboard. Whether or not the printing module 14 includes an operator interface 102, the control structure 100 is preferably conventionally adapted to include a two-way serial or parallel communications link, represented by the serial communications link 103, for conventionally coupling the control structure 100 to an external source, such as the local, printing computer 15. The communications link 103 includes a data output lead 104, for providing data signals, such the signal 105, to the printing computer 15, a data input lead 106, for receiving data signals, such as the signal 107, from the printing computer 15 and a clock lead 108, for receiving clock signals, such as the signal 109, from the printing computer 15 for synchronizing communications between the printing computer 15 and printing module 14. Thus the printing module 14 is preferably adapted to permit control of the structures and functions thereof from the printing computer 15 rather than from the operator interface 102.

The printing module 14 (FIG. 1) additionally includes conventional sheet stacking structure 110, such as a suitable hopper 112 into which a stack 114 of sheets 17D, may be loaded. The printing module 14 also includes conventional printing structure 115, such as any conventional ink jet, laser or other commercially available digital printing structure to which sheets 17D are fed from the hopper 112 for printing alphanumeric and graphic information thereon. In addition, the printing module 14 includes conventional sheet feeding structure 116 which is suitably electrically connected to and operable under the control of the control structure 100 for sequentially feeding sheets 17D from the stack 114. The feeding structure 116 may be any conventional vacuum or roller type structure for sequentially engaging the respective top or bottom sheet 17D in the stack 114 and feeding the respective sheets 17D from the hopper 112 to the printing structure 115 and, after printing, sequentially feeding the respective sheets 17D from the printing module 14. Further, the printing module 14 includes a suitable motor 118, which is connected to an operable under the control of the control structure 100, and includes one or more drive units 120, which are respectively connected between the motor 118 and feeding structure 116. Moreover, the printing module 14 may include a plurality of conventional sensors 122 for sensing various positions of respective sheets 17D and of selected elements of the feeding structure 116, motor 118 and drive units 120, including their respective home positions, at selected time intervals. The sensors 122 are conventionally electrically connected to the control structure 100 for providing analog signals thereto. And the control structure 100 is conventionally constructed arranged, for example as by programming in the case of the control structure 100 being a microprocessor, for providing digital signals, such as the signal 105, to the printing computer 15 which correspond to the various positions of respective sheets 17D, and to the respective positions of the selected elements of the feeding structure 116, motor 118 and drive units 120, at selected time intervals.

The printing computer 15 (FIG. 1), may be any commercially available computer, such as a conventional controller or personal computer. The printing computer 15 generally comprises a microprocessor 130, which includes conventional structure 132 having respective portions 132A–132J thereof, for providing a plurality of circuits, stored data and programs, A1–J1 inclusive, which respectively correspond in all respects to the circuits, stored data and programs, A–J inclusive, of the microprocessor 18. In addition, the structure 132 includes a portion 132K thereof for storing a printing computer program 200 for controlling the printing apparatus 13. Further, the structure 132 includes a portion 132L thereof for storing the serial number "SN" of the primary accounting apparatus 12 to which the printing apparatus 12 is authorized to be connected. Moreover, according to the invention, the portion 132L is also preferably utilized for storing the disablement verification code "VC", when received from the postage accounting apparatus 12 due to the disablement thereof from metering postage values 17B1, or, in another embodiment of the invention, when the disablement verification code "VC" is entered into the printing apparatus 13 by an authorized representative of the Postal Service or manufacturer to the primary accounting apparatus 12, including, for example, the User. In addition, the structure 132 includes a portion 132M thereof for storing a mailing address database "M1". Moreover, the structure 132 includes a portion 132Q thereof for storing a conventional hand shake routine "Q1" of the printing computer program 200, which utilizes the serial number "SN" of the postage accounting apparatus 12 for connecting the printing apparatus 13 in communication with the primary postage accounting apparatus 12 under the control of the primary computer program 300, or which utilizes the serial number "SN" and disablement verification code "VC" of the postage accounting apparatus 12 for connecting the printing apparatus 13 in communication with the secondary accounting apparatus 520 (FIG. 3) under the control of the secondary computer program 600. Still further, the structure 132 includes a portion 132R thereof for storing a printing routine "R1", for causing the printing computer 15 to obtain data corresponding to respective mailing addresses 86 (FIG. 2) from the mailing address database "M1" (FIG. 1), and to request data from the primary or secondary accounting apparatus, 13 or 520, corresponding to the current postage value 17B1 (FIG. 2 or 2A) and fixed portion 17C of the postage indicia 17A and corresponding to the encrypted information 16, and to merge such data for printing the address 86 and postage indicia 17A.

Further, rather than or in addition to the control structure 100 (FIG. 1), the printing computer 15 preferably includes a keyboard 135 for manually entering information concerning respective batches of sheets 17D into the printing apparatus 13 under the control of the microprocessor 130. Moreover, the printing computer 15 preferably includes a conventional display 136, which is conventionally connected to the microprocessor 130 and operable under the control thereof for displaying input received via the control circuit 100, keyboard 135 and microprocessor's communication ports A1.

As is well know in the art, if the descending register 60 (FIG. 1) of the accounting apparatus 12 does not have sufficient postage funds, represented by the total credit value "CV", stored therein for processing a batch of sheets 17D, then, the User of the postage metering system 10 may make a conventional telephone call from a local telephone 450 (FIG. 3), via a communication link 452, to a remotely located data center 500 to obtain additional postage funds therefrom. In this connection it is noted that the data center 500 generally comprises a conventional computer system 510, including a suitable interface 511, such as a conventional microprocessor. The computer system 510 also includes a conventional database 512, which is suitably connected in communication with the interface 511 and includes structure 512A for storing therein, for each User of any postage metering system 10, a credit amount "CA", and the serial number "SN", control sum "CS" and sequentially available encryption keys "ENK-1" stored in the User's postage metering system 10. In addition, the computer system 510 includes suitable voice recognition and speech synthesis structure 514, which is conventionally connected to the interface 511 and is constructed and arranged to respond to the User's telephone call, by generating a series of verbal inquiries requiring the User to provide the data center 500 with the serial number "SN" (FIG. 1), current total credit and debit values, "CV" and "DV", and control sum "CS" of the postage accounting apparatus 12, and the amount of additional postage funds the User is requesting to for crediting the descending register of the primary accounting apparatus 12. Moreover, the computer system 510 includes a conventional comparison circuit 515, which is suitably connected to the voice recognition and speech synthesis structure 514, for receiving data corresponding to the responses provided by the User to the aforesaid inquires, and which is suitably connected to the database 512, for fetching therefrom corresponding data, and, assuming that the User's credit amount "CA", stored in the accounting structure 512, includes sufficient funds to cover the requested postage funds, and that the sum of the requested credit and debit values, "CV" and "DV", are equal to the requested control sum "CS", and that the requested control sum "CS" and serial number "SN" correspond to those stored at the data center 500, then, the comparison circuit 515 will provide a favorable comparison response to the voice recognition and speech synthesis structure 514, which eventuates in the data center 500 verbally providing the User with a one-time-usage code "CD", having embedded therein the requested postage funds. To that end, the computer system 510 includes conventional code generating structure 516, which is suitably connected to the database 512 and has stored therein an algorithm "ALG" which deducts the requested funds from the credit amount "CA" stored in the-database 512 and utilizes the next available encryption key "ENK-1" and the requested value of postage funds, either alone or in combination with the "SN", for generating and providing to the User, via the voice recognition and speech synthesis structure 514, the one-time-usage code "CD". Thereafter, the User may enter the one-time-usage code "CD" into the accounting apparatus 12, for example, via the keyboard 135 of the printing apparatus 13, for adding the requested postage funds to the credit value "CV" stored in the descending register 60 of the accounting apparatus 12. Whereupon, in response to receiving the one-time-usage code "CD", the primary computer program 200 (FIG. 1) calls up the algorithm "AL" thereof for causing the microprocessor 18 to implement the steps of adding, to both the total credit value "CV" the control sum "CS", an amount corresponding to the funds embedded in the one-time-usage code "CD".

Further, as hereinbefore noted, it is desirable to permit Users of the postage metering systems 10 (FIG. 1) who are engaged in mass mailings of time sensitive materials, such as bills, to access to secondary accounting apparatus 520 (FIG. 3) for postage values 17B1 (FIG. 2 or 2A), when the primary accounting apparatus 12 (FIG. 1) experiences a critical-fault type of malfunction condition which results the primary accounting apparatus 12 being disabled from metering postage values 17B1 (FIG. 2 or 2A).

Since the data center 500 (FIG. 3) already includes accounting structure 512 for storing the serial number "SN" of the primary accounting apparatus 12 and a prepaid credit amount "CA" therefor, according to the invention, the postage metering system preferably includes the data center 500. And the data center 500 preferably includes the secondary accounting apparatus 520. Further, according to the invention the database 510 has stored therein, for selected Users thereof, a predetermined alphanumeric password or other verification code "VC", which corresponds to the User's disablement verification code "VC" and is unique to each selected User of a postage metering system 10 who is authorized to request the provision of respective postage values 17B1 (FIG. 2 or 2A) from the data center 500 (FIG. 3) when the selected User's primary postage accounting apparatus 12 (FIG. 1) is disabled from metering postage values 17B1 (FIG. 2 or 2A). And, for communicating with the secondary accounting apparatus 520, the postage metering system 10 additionally includes a conventional modem 522, having a telephone 524, for permitting authorized Users to call the data center 500, via a conventional data link and request removable connection in communication therewith for transmitting and receiving data signals, such as the signal 526, via the modem 522. The modem 522 includes a conventional serial communications link 528, having conventional interface structure, like the primary accounting apparatus' receptacle 24 for removably receiving the plug 24 of the printing apparatus 13. The link 528 includes a data output lead 528A, for providing data signals, such as the signal 34, to the modem 522. In addition, the link 528 includes a data input lead 528B, for receiving data signals, such as the signal 38, from the modem 522. And, the link 528 includes a clock lead 528C, for receiving clock signals, such as the signal 42, from the modem 522 for synchronizing communications between the data center 500 and the printing apparatus 12.

Preferably, the secondary accounting apparatus 520 (FIG. 3) comprises secondary computer structure 529 such as a suitable microprocessor 530 and keyboard 540 which is conventionally connected in communication therewith. The microprocessor 530 is constructed and arranged for providing postage indicia 17A (FIG. 2) including the variable and fixed portions 17B and 17C, thereof and thus the respective postage values 17B1, to the printing apparatus 13 (FIG. 1) when the primary accounting apparatus 12 is disabled from metering postage values 17B1. To that end, the microprocessor 530 is suitably connected in communication with the interface 511 and includes suitable structure 531 having respective portions 531A–531J thereof, for providing a plurality of circuits, stored data and programs, A2–J2 inclusive, which respectively correspond in all respects to the circuits, stored data and programs, A–J inclusive, of the microprocessor 18. In addition, the structure 531 includes a portion 531K thereof, for storing a secondary computer program 600 for controlling the secondary accounting apparatus 520. Moreover, according to the invention, the structure 531 includes a portion 531L for storing a fetching routine "L2" of the program 600 for fetching both the serial number "SN" of the User' primary accounting apparatus 12 and the disablement verification code "VC" pertaining thereto when the data center 500 receives a request for funds via the telephone 524. Moreover, the structure 531 includes a portion 531M for storing a handshake routine M2 of the program 600, which utilizes the fetched primary accounting apparatus serial number "SN" and disablement verification code "VC", and utilizes the User's corresponding serial number "SN" and code "VC" as received from the printing apparatus 13, for determining whether the User's printing apparatus 13 is authorized to use the primary accounting apparatus 12, that such apparatus 12 is disabled from metering postage values 17B1 and that the printing apparatus 13 is authorized to be connected to the secondary accounting apparatus 520. Moreover, assuming a favorable determination, the handshake routine M2 causes the secondary accounting apparatus 520 to connect the data center 500 in communication with the User's printing apparatus 13 via the modem 522. In addition, microprocessor structure 531 includes a portion 531N thereof for storing an algorithm "L2" of the program 600 for decrementing the credit amount "CA" by an increment thereof which is equal to the current postage value 17B1 (FIG. 2) of the postage indicia 17A requested for printing by the printing apparatus 14 (FIG. 1). Further, the structure 531 (FIG. 3) includes a portion 531P thereof for storing data corresponding to the fixed, graphic image "GI", portion 17C of a postage indicia 17A (FIG. 2 or 2A), as hereinbefore discussed. Still further, the microprocessor structure 531 includes a portion 531Q thereof for storing the encryption key(s) "ENK-2". In addition, structure 531 includes a portion 531R thereof for storing a printing routine "R2" of the program 600 for sequentially encrypting a portion of the data corresponding to each addressees address 86 as received from the printing apparatus, the sequentially requested postage value 17B1 and appropriate elements, if any, of a copy of the data corresponding to the fixed, graphic image "GI", portion of the postage indicia 17A, and sequentially transmitting the encryption and a plain text version of the postage indicia 17A to the printing apparatus 13 for printing thereby.

Figure 4A:
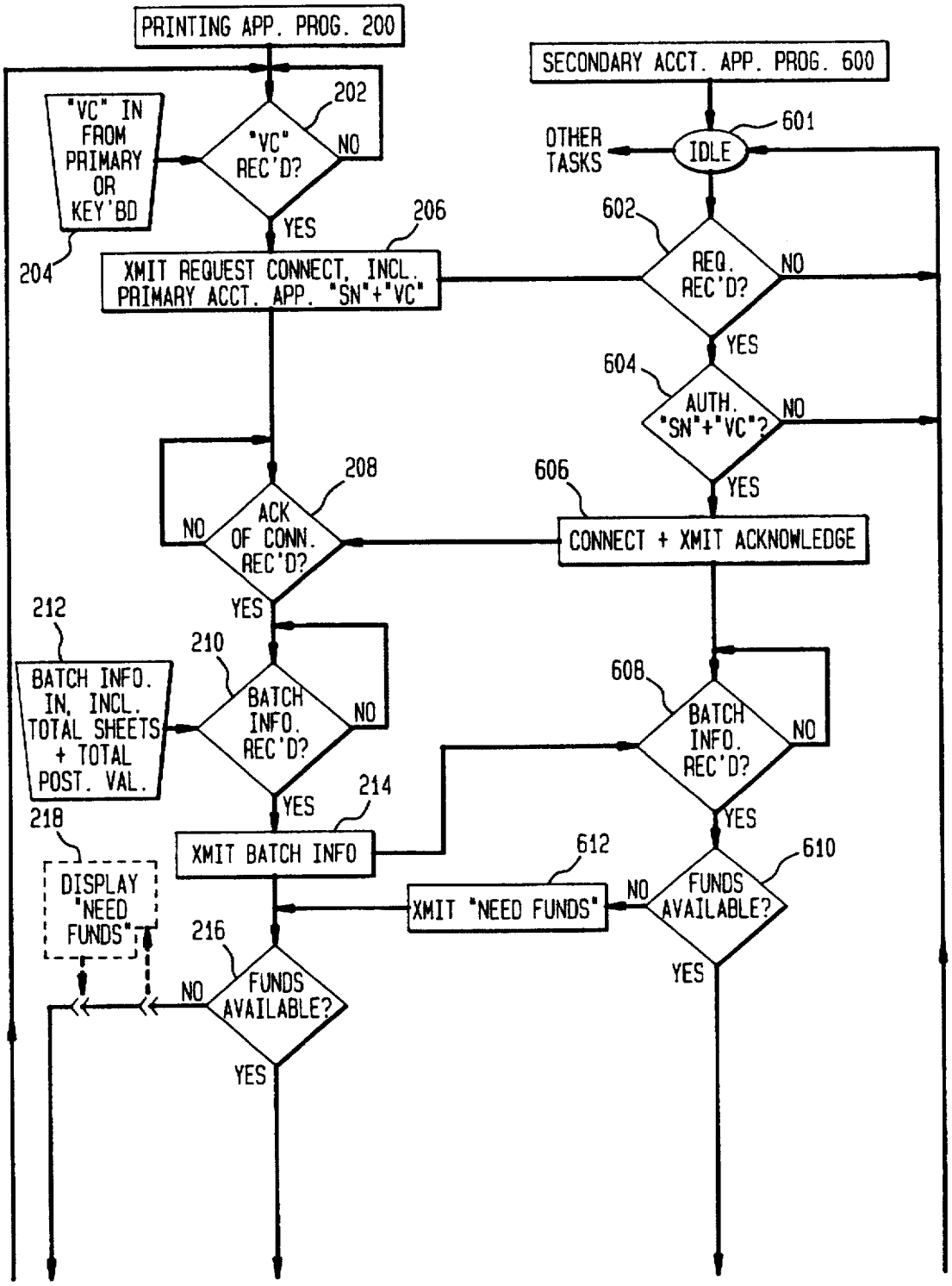
FIG. 4 is a flow chart of a process implemented by the printing apparatus and secondary accounting apparatus for causing the printing apparatus to be connected thereto, print respective postage indicia received from the secondary accounting apparatus and be disconnected therefrom.
Figure 4B:
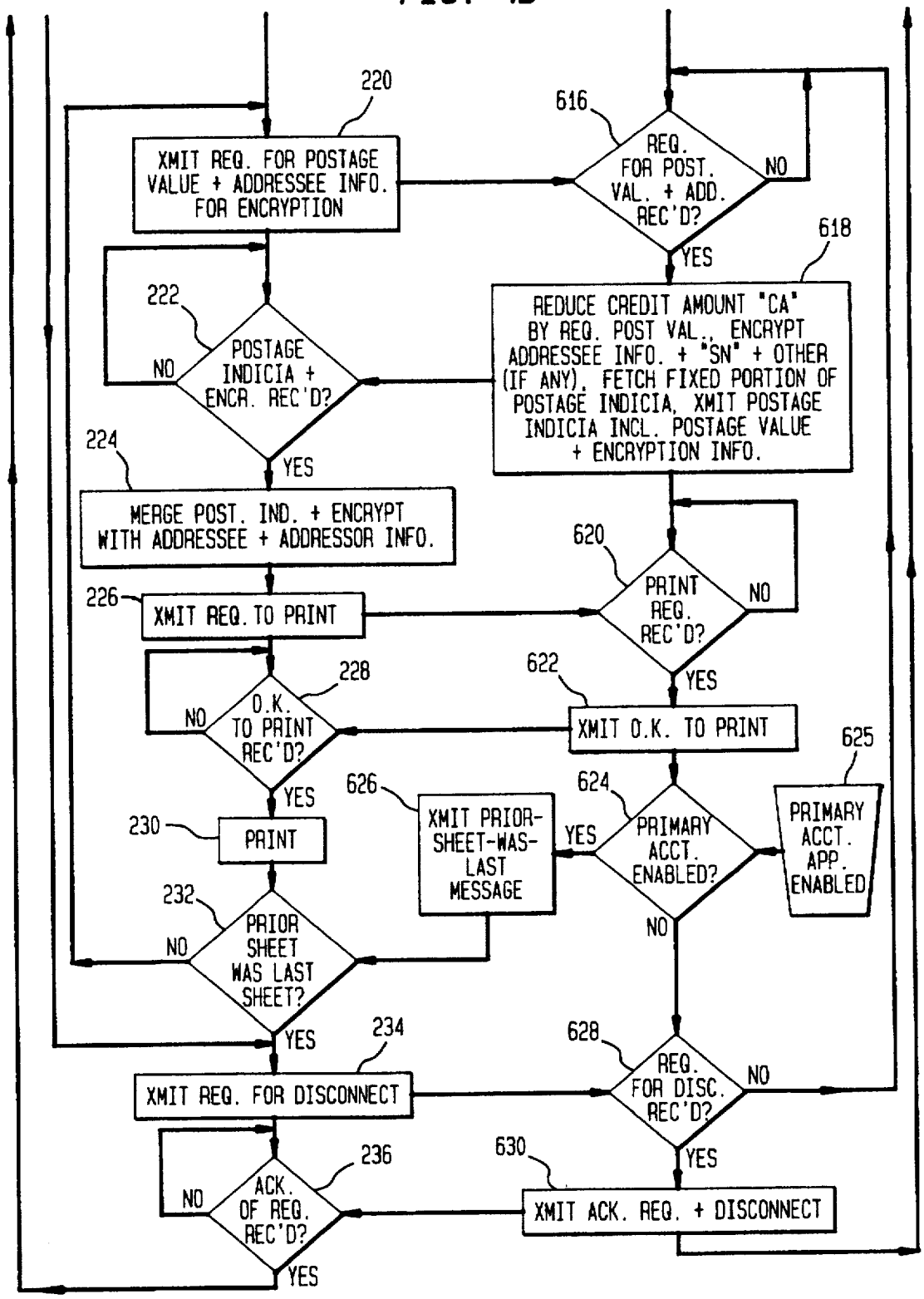

The following discussion of FIG. 4 assumes prior energization of the postage metering system 10 (FIG. 1) and thus the postage primary accounting apparatus 12 and printing apparatus 13, and, that prior to or in the course of processing a batch of sheets 17D the primary accounting apparatus 12 has experienced a critical fault type of malfunction condition resulting in the primary accounting apparatus 12 being disabled from metering postage values 17B1 (FIG. 2 or 2A), and that the User has connected the printing apparatus plug 86 (FIG. 1) to the receptacle 24 (FIG. 3) with a view to calling the data center 500 to establish communications with the secondary accounting apparatus 520 for receiving therefrom respective postage indicia 17A (FIG. 2 or 2A), including respective postage values 17B1, for processing respective sheets 17D.

As shown in FIG. 4 the printing apparatus program 200 initially causes implementation of the step 202 of inquiring whether the disablement verification code "VC" has been received, either from the primary accounting apparatus 12 (FIG. 1) or via the keyboard 135, as hereinbefore discussed. And, assuming the code "VC" has not been received, step 202, then, the program 200 causes the computer 15 to continuously loop through step 202 until the code "VC" 204 is received, step 202. Assuming the code "VC" is received, step 202, the program 200 causes implementation of the step 206 of transmitting a request to the data center 500, together with the serial number "SN" of the primary accounting 12 and disablement verification code "VC" thereof, that the secondary accounting apparatus 520 establish communication connection with the printing apparatus 13, followed by the step 208 of inquiring whether an acknowledgment of establishment of the requested connection has been received from the data center 500, failing which, the program 200 causes the printing apparatus computer 15 to continuously loop through step 208 until the acknowledgment is received.

On the other hand, the secondary accounting apparatus accounting program 600 (FIG. 4), which, for the purposes of discussion, is assumed to be involved with multiple tasks branching from the idle 601, periodically causes the secondary accounting apparatus microprocessor 530 to implement the step 602 of inquiring whether communications connection request 206, has been received, step 602, from the printing apparatus 13, and, assuming that it has not, step 602, then, the program 600 causes the microprocessor 530 to continuously loop through idle 601 to step 602, until the request 206 is received, step 602. Whereupon, the program 600 causes the microprocessor 530 to implement the step 604 of inquiring whether the serial number "SN" and disablement verification code "VC" which accompanied the request 206, compare to any of the plurality of serial number "SN" and code "VC" pairs stored in the database 512 (FIG.

3) and are thus an authorized pair of a serial number "SN" and code "VC", and, assuming that they are not an authorized pair, step 604 (FIG. 4), then, the program 600 causes the microprocessor 530 to continuously loop through idle 601 and step 602 to step 604, until the request 206 is received which includes an authorized pair of a serial number "SN" and code "VC", step 602. Assuming the request 206 is accompanied by an authorized pair of a serial number "SN" and code "VC", then, the program 600 causes the microprocessor 530 to implement the step 606 of connecting the printing apparatus 13 in communication with the secondary accounting apparatus 520 and transmitting a message of acknowledgment thereof to the printing apparatus 12, followed by the step 608, through which processing continuously loops until an affirmative answer is received, of inquiring whether information pertaining to processing a batch of sheets 17D has been received from the printing apparatus 13. Without departing from the spirit and scope of the invention, the message of acknowledgment, step 606, may include conventional data for causing the printing apparatus microprocessor 130 to drive the display 136 to display a suitable message of acknowledgment.

Having received the connection acknowledgment message step 208 (FIG. 4), the printing apparatus computer program 200 then causes the printing apparatus computer 15 to implement the step 210 of inquiring whether the processing information pertaining to a batch of sheets 17D which is to be processed, including the total number thereof in the batch and the total postage value which is needed for processing, has been received, for example, due to having been entered, step 212, into the printing computer 15 via the keyboard 135. And, assuming such batch processing information, step 212, has not been received, step 210, then, the program 200 continuously loops through step 210 until the batch processing information is received, step 210. Whereupon, the program 200 causes implementation of the step 214 of transmitting the batch processing information to the secondary accounting apparatus 520, followed by the step 216 of inquiring whether sufficient are available, and thus whether sufficient funds are credited to the credit amount "CA" of the User, at the data center 500 for processing the batch of sheets 17D.

Upon receiving the batch processing information step 608 (FIG. 4) the secondary accounting apparatus computer program 600 then causes the secondary apparatus microprocessor 530 to implement the step 610 of inquiring whether sufficient funds are available. Step 610 may include the step of comparing the credit amount "CA" available to the printing apparatus 12 with the total postage value needed to process the sheets 17D of the batch, and the step of determining whether the credit amount "CA" is equal to or exceeds the total postage value needed for the batch. Assuming the available funds are insufficient, the program 600 causes implementation of the step 612 of transmitting a message to the printing apparatus 13 indicating that funds are needed. Without departing from the spirit and scope of the invention, the funds-needed message, step 612, may include data for causing the printing apparatus microprocessor 130 (FIG. 1) to drive the computer display 136 for displaying an appropriate message such as "need funds". As previously noted, a predicate for providing Users of printing apparatus 13 with access to a secondary source of postage indicia 17A at a data center 500, is to help selected batch mail processors to avoid costly down time of their primary accounting apparatus 12. On the other hand, since a data center 500, normally services hundreds of thousands of postage metering systems 10 it would be unduly burdened if a User to whom it was connected had not deposited sufficient funds in their credit account "CA" to process their batch of sheets 17D. Therefore, upon receiving the funds-needed message, step 216, the program 200 preferably causes implementation of the step 234, hereinafter discussed, of transmitting a request to the secondary accounting apparatus 520 to disconnect the printing apparatus 12 therefrom, alone or in combination with the step 218 of causing the printing computer display 136 to display a funds-needed message.

Assuming sufficient funds are available, step 610 (FIG. 4) the secondary accounting apparatus program 600 causes implementation of the inquiry of step 616, through which processing continuously loops until an affirmative answer is received, of determining whether a request for a postage value 17B1 (FIG. 2 or 2A) has been received. The inquiry of step 616 may also include a request for data corresponding to a portion of the addressee address 86 of the sheet 17D, preferably the zip code 87, for encryption purposes. Assuming a funds-needed message, step 612 (FIG. 4), is not received, funds are assumed to be available, step 216, and the printing apparatus program 200 causes implementation of the step 220 of transmitting a request for a postage value 17B1 (FIG. 4) and, if requested, the appropriate data corresponding to the addressee's address 86, followed by the step 222 of inquiring whether the postage indicia 17A (FIG. 2 or 2A) has been failing which, the program 200 causes the printing apparatus computer 15 to continuously loop through step 228 until the postage indicia 17A has been received. Step 616 may include inquiring whether the encryption code 16 has been received. When the request for a postage value 17B1 is received, step 222, the program 600 causes implementation of the step 618 of reducing the credit amount "CA" by an amount corresponding to the requested postage value 17B1 (FIG. 2 or 2A), copying the fixed portion 17C of the postage indicia 17A, generating an encryption code 16 including, data corresponding to the addressee address 86, if any, received from the printing apparatus 13 and a copies of the serial number "SN", the postage value 17B1 and optionally the current date 84 or a selected part of the fixed portion 17C of the postage indicia 17A, and merging and transmitting the postage indicia 17A and encryption code 16 to the printing apparatus 12 for printing thereby. Thereafter, the program 600 causes implementation of the step 620 of inquiring whether a request to print has been received from the printing apparatus 13, failing which, processing continuously loops through step 620 until the request to print is received. When the printing apparatus 13 receives the transmission of the postage indicia 17A and encryption code 16, step 222, the program 200 causes implementation of the step 224 of merging the postage indicia 17A, encryption code 16 and addresses 86 and 88, followed by the step 226 of transmitting a request to print to the secondary accounting apparatus 520 followed by the step 228 of inquiring whether request to print has been received from the data center 500, failing which, the program 200 causes the printing apparatus computer 15 to continuously loop through step 228 until the request is received. When the secondary accounting apparatus 520 receives the request to print, step 620, the program 600 causes implementation of the step 622 of transmitting a permission-to-print message to the printing apparatus 13. When permission to print is received at step 228 the printing program 200 causes implementation of the step 230 of driving the printing apparatus 13 to print the postage indicia 17A, encryption code 16 and addresses 86 and 88 on a sheet 17D, followed by the step 232 of inquiring whether that prior sheet 17D was the last sheet 17D to be processed by the secondary accounting apparatus 12. Assuming that the prior sheet 17D was not the last sheet 17D to be processed, step 232, the program 200 causes processing to be returned to step 220 for requesting the next postage value 17B1.

Following transmission of the permission-to-print message, step 622 (FIG. 4) the secondary accounting apparatus program 600 causes implementation of step 624 of inquiring whether the primary accounting apparatus 12 has been enabled, and assuming a message to that effect has not been entered into the apparatus 520, step 625, the inquiry of step 624 is negatively answered. Whereupon the program 600 causes implementation of the step 628 of inquiring whether a request for disconnection thereof from the printing apparatus 12 has been received, and, assuming that it has not, the program 600 returns processing to step 616 to await the next request for a postage value 17B1.

Assuming that the prior sheet 17D (FIG. 4) was the last sheet 17D to be processed, step 232, then, the printing apparatus program 200 causes the printing computer 15 to implement the step 234 of transmitting request to the secondary accounting apparatus 52 to disconnect the printing apparatus 13 therefrom. Thereafter, the program 200 causes implementation of the step 236 of inquiring whether an acknowledgment of the disconnection request has been received from the secondary accounting apparatus 520, and, assuming that it has not, the program 200 causes processing to continuously loop through step 236, until the acknowledgment is received. When the secondary accounting apparatus 520 receives the disconnection request, step 628, the program 600 causes the secondary apparatus computer 530 to transmit the acknowledgment of the disconnection request to the printing apparatus 13 and disconnect the secondary accounting apparatus 520, and thus the data center 500, from the printing apparatus 13, followed by returning processing to idle 601 to await the next request for connection of the secondary accounting apparatus 520 to printing apparatus 13.

At any time in the course of the printing apparatus 13 requesting postage values 17B1 from the secondary accounting apparatus 520, an authorized service person may have cleared the malfunction condition which caused disablement of the primary accounting apparatus 12 and returned the apparatus 12 to service. Whereupon, according to the invention, the aforesaid service person, User of the printing apparatus 13 or other authorized person is obliged to place a telephone call to the data center 500 to report the enablement of the primary accounting apparatus 12. Since hundreds of thousands of postage metering systems of all types are serviced from the data center 500, and it is in the best interests of all of the Users of such systems that their service needs be expeditiously satisfied, the printing apparatus 13 is preferably disconnected from the secondary accounting apparatus 520 within a reasonable time period from the time the data center 500 receives the telephone report of enablement of the primary accounting apparatus 12. For the purposes of this disclosure, a reasonable time period may be measured in hours or minutes, depending on the workload experience of the data center, or be a variable time period, such as the time period needed for completion of processing the batch of sheets 17D then being processed by the secondary accounting apparatus 520. Thus, within a reasonable time period from receiving the telephone report of enablement of the primary accounting apparatus 12, an authorized representative of the data center 500 may input a message, step 625, into the secondary accounting apparatus 520, for example, via the keyboard 540 thereof, indicating that the primary accounting apparatus 12 has been enabled. As a result, the secondary accounting apparatus computer program 600 causes the inquiry of step 624 to be affirmatively answered, and then causes implementation of the step 626 of transmitting a message the printing apparatus 13 indicating that the prior sheet 17D was the last sheet 17D to be processed by the secondary accounting apparatus 520. Upon receiving the prior-sheet-was-last message, the printing apparatus program 200 causes the printing apparatus to sequentially implement disconnection-request and request-acknowledgment steps, 234 and 236, followed by returning processing to step 202, as hereinbefore discussed, which, in turn, result in the secondary accounting apparatus program 600 causing sequential implementation of the disconnection-request-received and disconnection-acknowledgment/data center-disconnection, steps 628 and 630, followed by returning processing to idle 601.

What is claimed is:

1. A postage metering system comprising:

(a) primary accounting means including primary computer means, the primary computer means including means for sequentially metering respective postage values for printing on respective sheets, the primary computer means including means for detecting a plurality of fault conditions, the primary computer means including means for disabling the metering means when the detecting means detects a selected fault condition;

(b) printing means including a printing module and printing computer means, the printing module including printing apparatus and means for sequentially feeding thereto each sheet of a batch thereof having a predetermined plurality of sheets, the printing computer means including means for transmitting a first request for connection of the printing means in communication with the primary accounting means for receiving therefrom respective postage values for printing on respective sheets;

(c) the primary computer means including means responsive to the first connection request for causing connection of the accounting means in communication with the printing means if the metering means is not disabled, the primary computer means including means for causing disconnection of the accounting means from communication with the printing means if connected in communication therewith when the metering means is disabled; and (d) the printing computer means including means for transmitting a second request for connection of the printing means in communication with secondary accounting means for receiving therefrom respective postage values for printing on respective sheets if the metering means is disabled.

2. The postage metering system according to claim 1, wherein the printing computer means includes means utilizing information verifying that the metering means is disabled for generating the second connection request.

3. The postage metering system according to claim 1, wherein the primary computer means includes means for storing a total postage credit value, the metering means including means for sequentially reducing the total postage credit value by increments thereof corresponding to postage values sequentially metered when the printing means is connected to the primary accounting means, the postage metering system including a data center remotely located from the primary accounting means, the data center including postage funds available for crediting the total postage credit value, the data center including the secondary accounting means, the secondary accounting means including means for sequentially providing respective postage values for printing on respective sheets, and the secondary accounting means including means for debiting the available postage funds by increments thereof corresponding to postage values sequentially provided when the printing means is connected to the secondary accounting means.

4. The postage metering system according to claim 1, wherein the primary computer means includes means for providing information verifying that the metering means is disabled when the metering means is disabled.

5. The postage metering system according to claim 4, wherein the information includes a code verifying that the metering means is disabled, and the second connection request including the code.

6. The postage metering system according to claim 1, wherein the printing computer means includes means for sequentially transmitting information concerning each sheet to the connected accounting means.

7. The postage metering system according to claim 6, wherein the computer means of the connected accounting means includes means for storing a total value of postage available for printing, the computer means of the connected accounting means including means for sequentially using the information transmitted by the printing means to determine for each sheet an amount of an increment of the total postage value, and the computer means of the connected accounting means including means for sequentially reducing the total postage value by the amount of the increment determined for each sheet and providing data corresponding to the determined increment to the printing means for printing thereby.

8. The postage metering system according to claim 1 including the secondary accounting means, the secondary accounting means including secondary computer means, the secondary computer means including means responsive to the second connection request for causing connection of the secondary accounting means in communication with the printing means if the metering means is disabled.

9. The postage metering system according to claim 8, wherein the printing means is non-secure.

10. The postage metering system according to claim 8, wherein the primary computer means includes means for providing information verifying that the metering means is disabled when the metering means is disabled.

11. The postage metering system according to claim 10, wherein the information includes a code verifying that the metering means is disabled, the second connection request including the code, and the secondary accounting means including means utilizing the code for determining whether the metering means is disabled.

* * * * *